US006902230B2

(12) United States Patent
Chen

(10) Patent No.: US 6,902,230 B2
(45) Date of Patent: Jun. 7, 2005

(54) FOLDABLE CHILD SUPPORT DEVICE

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 10/641,737

(22) Filed: Aug. 15, 2003

(65) Prior Publication Data

US 2005/0035631 A1 Feb. 17, 2005

(51) Int. Cl.[7] ..... A47C 4/00
(52) U.S. Cl. ..... 297/16.1
(58) Field of Search ..... 297/16.1, 20, 32, 297/33, 55, 258.1, 260.3, 270.1, 377; 403/102

(56) References Cited

U.S. PATENT DOCUMENTS 5,207,478 A * 5/1993 Freese et al. ..... 297/296
5,269,591 A * 12/1993 Miga et al. ..... 297/452.13
5,503,458 A * 4/1996 Petrie ..... 297/452.13
5,868,459 A * 2/1999 Welsh, Jr. ..... 297/32
6,361,106 B1 * 3/2002 Huang ..... 297/32
2003/0034685 A1 2/2003 Sonner et al.

* cited by examiner

*Primary Examiner*—Peter M. Cuomo
*Assistant Examiner*—Stephen Vu
(74) *Attorney, Agent, or Firm*—Webb Ziesenheim Logsdon Orkin & Hanson, P.C.

(57) ABSTRACT

A foldable child support device includes a main frame unit, first and second frame units, and a seat support member. The main frame unit includes left and right frame portions. The first frame unit includes a first rod member, two arm members connected respectively to the left and right frame portions, and a first connector unit for connecting pivotally the first rod member to the arm members such that the first frame unit is foldable. The second frame unit includes a second rod member, a third rod member connected pivotally to the main frame unit, and a second connector unit for interconnecting pivotally the second rod member and the third rod member such that the second frame unit is foldable. The seat support member is mounted on the main frame unit, and cooperates with the first frame unit to define a seating area.

2 Claims, 4 Drawing Sheets

FOLDABLE CHILD SUPPORT DEVICE

BACKGROUND OF THE INVENTION

1. Field of the Invention

The invention relates to a child support device, more particularly to a foldable child support device.

2. Description of the Related Art

In U.S. Patent Application Publication No. 2003/0034685, there is disclosed a child support device in the form of a child's bouncer seat that includes a U-shaped lower frame, a U-shaped back supporting frame coupled to the lower frame through a pair of connectors, and a U-shaped seat frame coupled to upper ends of the lower frame.

Although the aforesaid child support device can be disassembled for storage and transport purposes, frequent assembly and disassembly of the child support device is inconvenient to conduct.

SUMMARY OF THE INVENTION

Therefore, the object of the present invention is to provide a foldable child support device that can overcome the aforesaid drawback associated with the prior art.

According to the present invention, a foldable child support device includes a main frame unit, first and second frame units, and a seat support member.

The main frame unit includes left and right frame portions.

The first frame unit includes a first rod member with left and right rod ends, a pair of arm members, and a first connector unit. Each of the arm members has a rod connecting end and a frame connecting end opposite to the rod connecting end and connected to a respective one of the left and right frame portions. The first connector unit connects pivotally and respectively the left and right rod ends of the first rod member to the rod connecting ends of the arm members such that the first frame unit is foldable about a first folding axis.

The second frame unit includes a second rod member, a third rod member having a rod connecting section and a frame connecting section opposite to the rod connecting section and connected pivotally to the main frame unit such that the second frame unit is rotatable relative to the main frame unit about a second folding axis, and a second connector unit for interconnecting pivotally the second rod member and the rod connecting section of the third rod member such that the second frame unit is foldable about a third folding axis.

The seat support member is mounted on the main frame unit and cooperates with the first frame unit to define a seating area.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
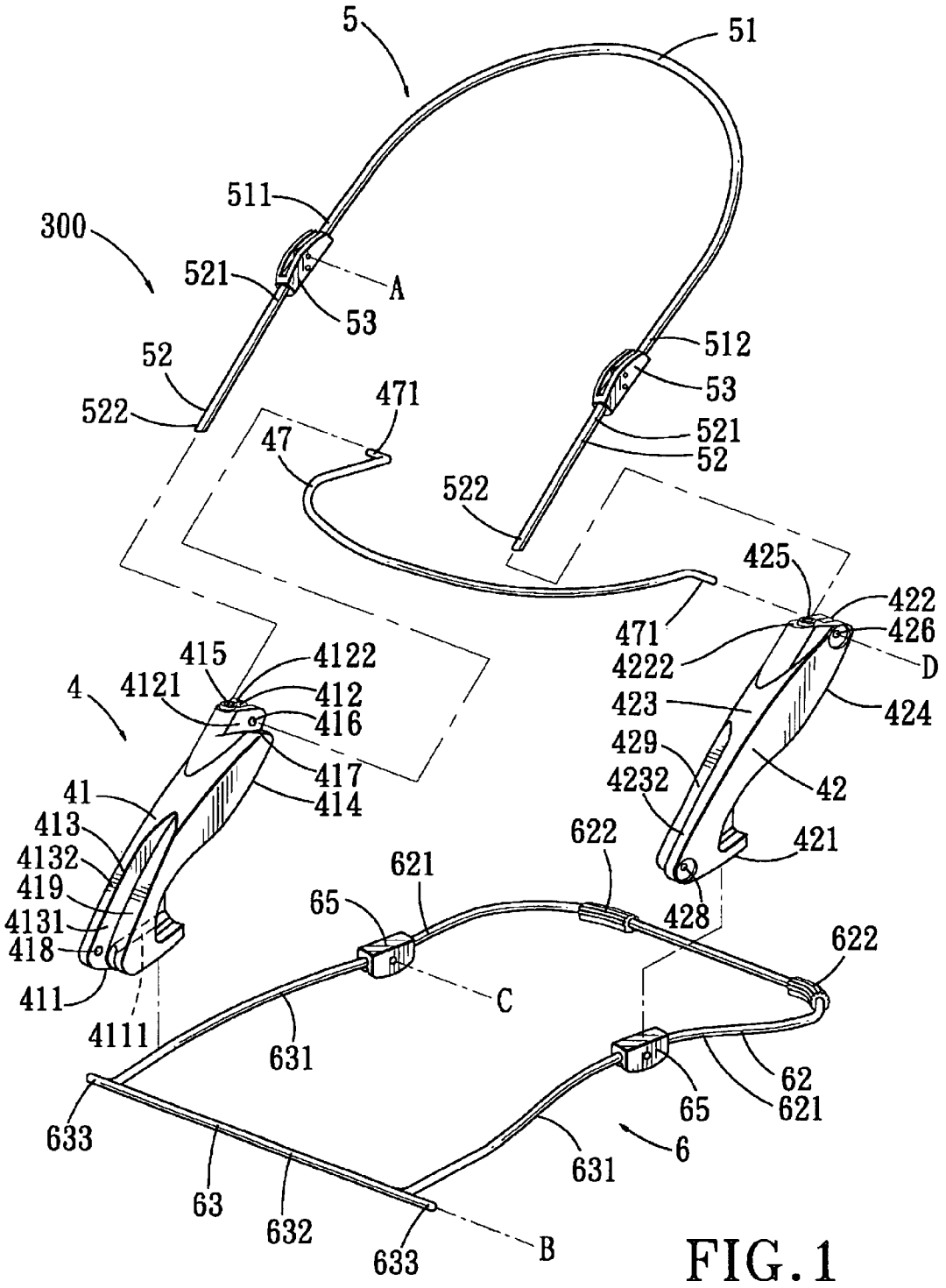
FIG. 1 is an exploded perspective of the preferred embodiment of a foldable child support device according to the present invention.
Figure 2:
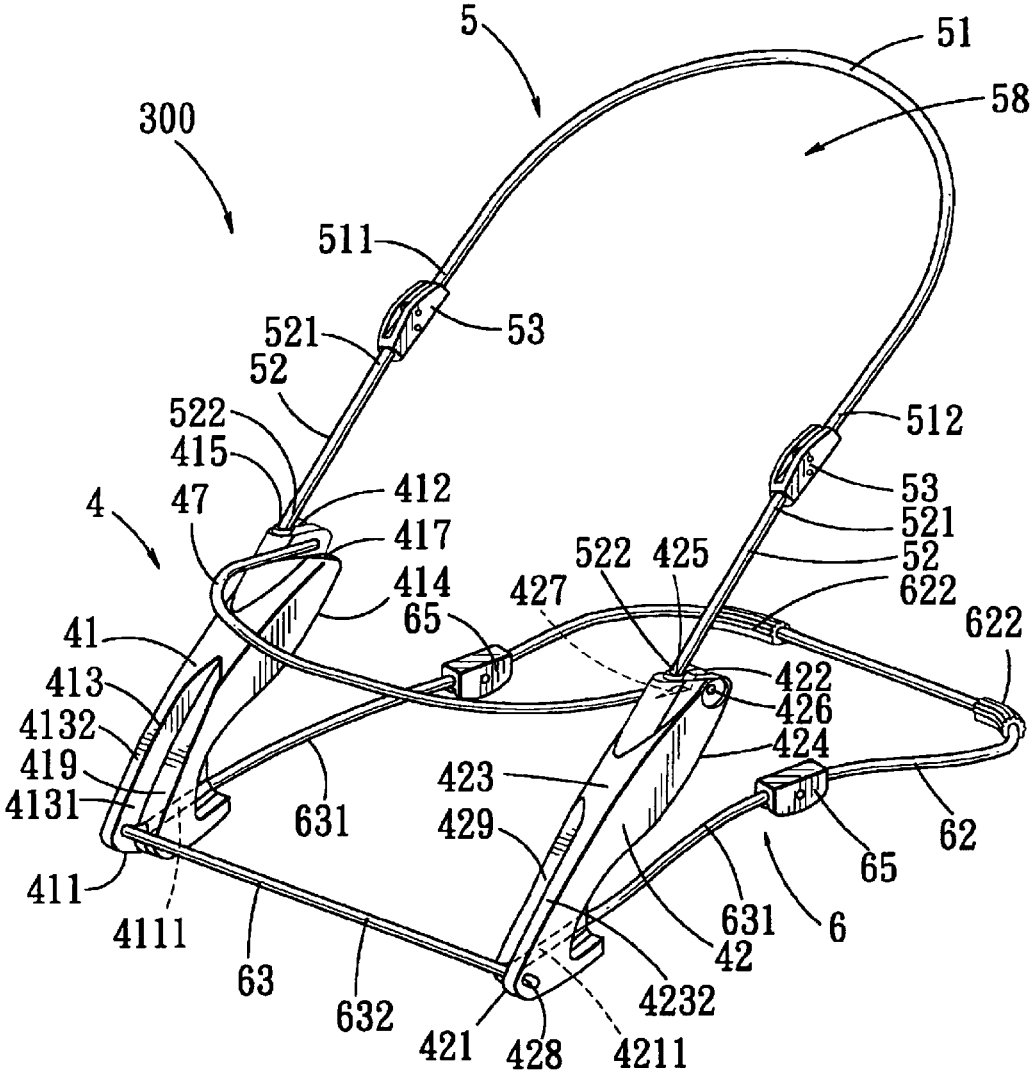
FIG. 2 is an assembled perspective view of the preferred embodiment.

Referring to FIGS. 1 and 2, the preferred embodiment of a foldable child support device 300 according to the present invention is shown to be embodied in a child's bouncer seat that includes a main frame unit 4, first and second frame units 5, 6, and a seat support member 47.

The main frame unit 4 includes upright left and right frame portions 41, 42 that are symmetrical in construction. While the left and right frame portions 41, 42 are shown to be separate from each other in the present embodiment, it is apparent to those skilled in the art that the left and right frame portions of the main frame unit may be connected integrally to each other in other embodiments of the present invention. Each of the left and right frame portions 41, 42 is in the form of an elongate body having a bottom side 411, 421, a top side 412, 422 opposite to the bottom side 411, 412, a front side 413, 423 extending from the bottom side 411, 421 to the top side 412, 422, and a rear side 414, 424 opposite to the front side 413, 423. The bottom sides 411, 421 of the left and right frame portions 41, 42 are adapted to be placed on a flat surface (not shown), and the left and right frame portions 41, 42 extend upwardly and inclinedly when placed on the flat surface.

The top side 412, 422 of each of the left and right frame portions 41, 42 has a stepped configuration, and includes an upper step face 4122, 4222, a lower step face 417, 427 disposed at an inner lateral side of the respective frame portion 41, 42, and an upright lateral face 4121 that extends between the upper and lower step faces 4122, 417, 4222, 427. A first engaging hole 415, 425 is formed in the upper step face 4122, 4222 of the respective frame portion 41, 42. A second engaging hole 416, 426 is formed through the lateral face 4121 of the respective frame portion 41, 42.

The lower portion of the front side 413, 423 of each of the left and right frame portions 41, 42 also has a stepped configuration, and includes a front step face 4132, 4232, a rear step face 419, 429 disposed at an inner lateral side of the respective frame portion 41, 42, and an upright lateral face 4131 that extends between the front and rear step faces 4132, 419, 4232, 429. A third engaging hole 418, 428 is formed through the lateral face 4131 of the respective frame portion 41, 42.

The bottom side 411, 421 of each of the left and right frame portions 41, 42 is formed with an elongate groove 4111, 4211 that extends from the rear side 414, 424 through the rear step face 419, 429 of the respective frame portion 41, 42.

Figure 3:
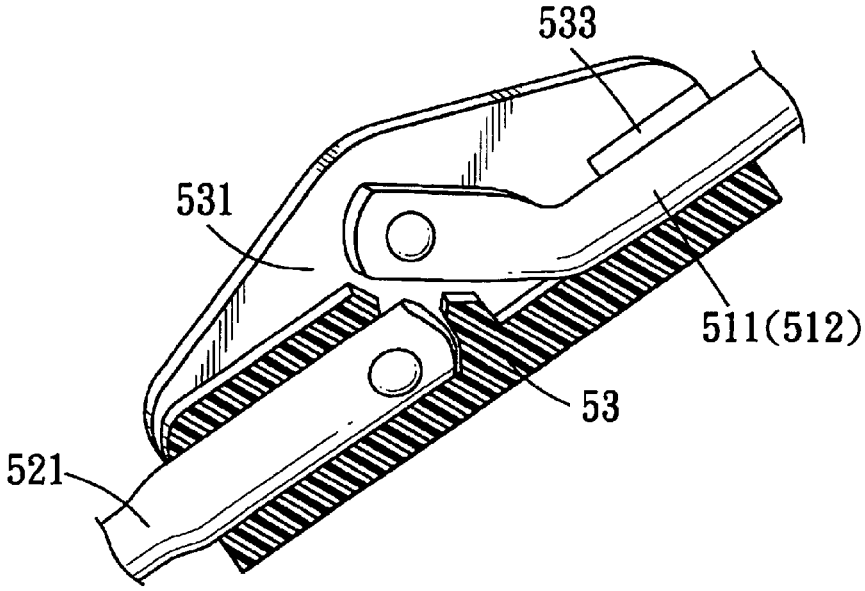
FIG. 3 is a fragmentary, partly cutaway, perspective view of a first frame unit of the preferred embodiment.

With further reference to FIG. 3, the first frame unit 5 includes a first rod member 51 with left and right rod ends 511, 512, a pair of arm members 52, and a first connector unit including two first connectors 53. In this embodiment, the first rod member 51 is generally U-shaped. Each of the arm members 52 has a rod connecting end 521 and a frame connecting end 522 opposite to the rod connecting end 521 and connected to a respective one of the left and right frame portions 41, 42. Particularly, the frame connecting ends 522 of the arm members 52 are retained in the first engaging holes 415, 425 in the left and right frame portions 41, 42, respectively. Each of the first connectors 53 is formed with a first pivot groove 531. The left and right rod ends 511, 512 of the first rod member 51 are mounted pivotally and respectively in the first pivot grooves 531 of the first connectors 53. On the other hand, the rod connecting ends 521 of the arm members 52 in this embodiment are connected non-rotatably to the first connectors 53, respectively. Accordingly, the first connector unit connects pivotally and respectively the left and right rod ends 511, 512 of the first rod member 51 to the rod connecting ends 521 of the arm members 52 such that the first frame unit 5 is foldable about a first folding axis (A). In the preferred embodiment, the first rod member 51 forms an angle of approximately 180 degrees with the arm members 52 when the first frame unit 5 is unfolded. Each of the first connectors 53 is further formed with stop means, in the form of a stop rib 533 that projects into the first pivot groove 531, for providing resistance to pivoting movement of the first rod member 51 when the first frame unit 5 is in the unfolded state. The first rod member 51 is folded toward the front sides 413, 423 of the left and right frame portions 41, 42 to dispose the first frame unit 5 in a folded state.

Figure 4:
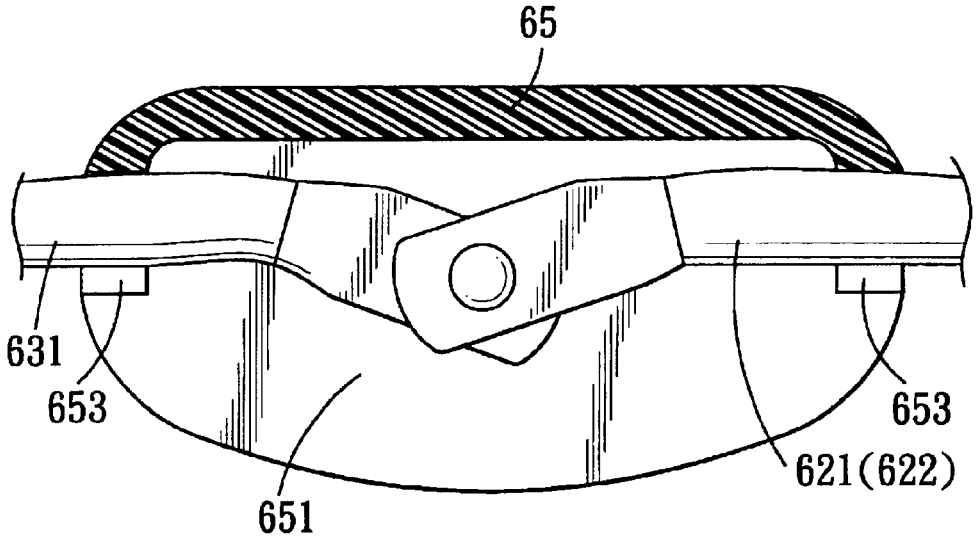
FIG. 4 is a fragmentary, partly cutaway, schematic view of a second frame unit of the preferred embodiment.

Referring further to FIG. 4, the second frame unit 6 includes second and third rod members 62, 63 and a second connector unit including two second connectors 65. Each of the second and third rod members 62, 63 is generally u-shaped in this embodiment. An anti-slip unit, in the form of a pair of anti-slip blocks 622, is mounted on an intermediate section of the second rod member 62. The third rod member 63 includes a frame connecting section 632 and a pair of rod connecting sections 631 connected to the frame connecting section 632. The frame connecting section 632 is formed with a pair of lateral pivot pins 633 that extend pivotally and respectively into the third engaging holes 418, 428 in the left and right frame portions 41, 42 such that each of the rod connecting sections 631 extends from the front side 413, 423 through the rear side 414, 424 along the elongate groove 4111, 4211 in the respective frame portion 41, 42. Accordingly, the second frame unit 6 is rotatable relative to the main frame unit 4 about a second folding axis (B) defined by the pivot pins 633 and parallel to the first folding axis (A) between an unfolded position, where the rod connecting sections 631 extend through the elongate grooves 4111, 4211, and a folded position, where the rod connecting sections 631 abut against the rear step face 419, 429 of the front side 413, 423 of the respective frame portion 41, 42.

Each of the second connectors 65 is formed with a second pivot groove 651 that opens downwardly in an unfolded state of the second frame unit 6. Left and right ends 621, 622 of the second rod member 62 and the rod connecting sections 631 of the third rod member 63 are mounted pivotally and respectively in the second pivot grooves 651 of the second connectors 65. Accordingly, the second connector unit interconnects pivotally the second rod member 62 and the rod connecting sections 631 of the third rod member 63 such that the second frame unit 6 is foldable about a third folding axis (C) parallel to the first and second folding axes (A, B). In the preferred embodiment, the second and third rod members 62, 63 form an angle of approximately 180 degrees therebetween when the second frame unit 6 is unfolded. Each of the second connectors 65 is further formed with stop means, in the form of a pair of stop ribs 653 that project into the second pivot groove 651, for providing resistance to pivoting movement of the second rod member 62 and the rod connecting sections 631 of the third rod member 63 when the second frame unit 6 is in the unfolded state.

In this embodiment, the seat support member 47 is generally U-shaped, and has a pair of pivot ends 471 mounted pivotally and respectively in the second engaging holes 416, 426 in the left and right frame portions 41, 42 of the main frame unit 4 such that the seat support member 47 is rotatable relative to the main frame unit 4 about a fourth folding axis (D) parallel to the first, second and third folding axes (A, B, C) When the seat support member 47 is in an unfolded position, the seat support member 47 abuts against the lower step faces 417, 427 on the left and right frame portions 41, 42, extends forwardly relative to the front sides 413, 423 of the left and right frame portions 41, 42, and is disposed generally parallel to the top sides 412, 422 of the left and right frame portions 41, 42 such that the seat support member 47 cooperates with the first frame unit 5 to define a seating area 58 adapted for mounting a seat cushion (not shown) to permit seating of a child on the support device of this invention.

In use, the first frame unit 5 is unfolded so that the first rod member 51 forms an angle of approximately 180 degrees with the arm members 52 (as best shown in FIGS. 2 and 3), and the second frame unit 6 is unfolded so that the second and third rod members 62, 63 form an angle of approximately 180 degrees therebetween (as best shown in FIGS. 2 and 4), and so that the rod connecting sections 631 of the third rod member 63 extend through the elongate grooves 4111, 4211 in the left and right frame portions 41, 42. Thus, when the bottom sides 411, 421 of the left and right frame portions 41, 42 and the unfolded second frame unit 6 are placed on a flat surface (not shown), the first frame unit 5 extends at an angle relative to the flat surface. Due to the anti-slip unit on the second rod member 62, the foldable child support device 300 is able to stand firmly on the flat surface. The seat support member 47 is then unfolded to abut against the lower step faces 417, 427 of the left and right frame portions 41, 42 and to be disposed generally parallel to the top sides 411, 421 of the left and right frame portions 41, 42, thereby resulting in the seating area 58 that permits mounting of the seat cushion (not shown). The child support device 300 is now ready for use, whereby a bouncing effect is possible in view of the resiliency of the various frame components thereof.

Figure 5:
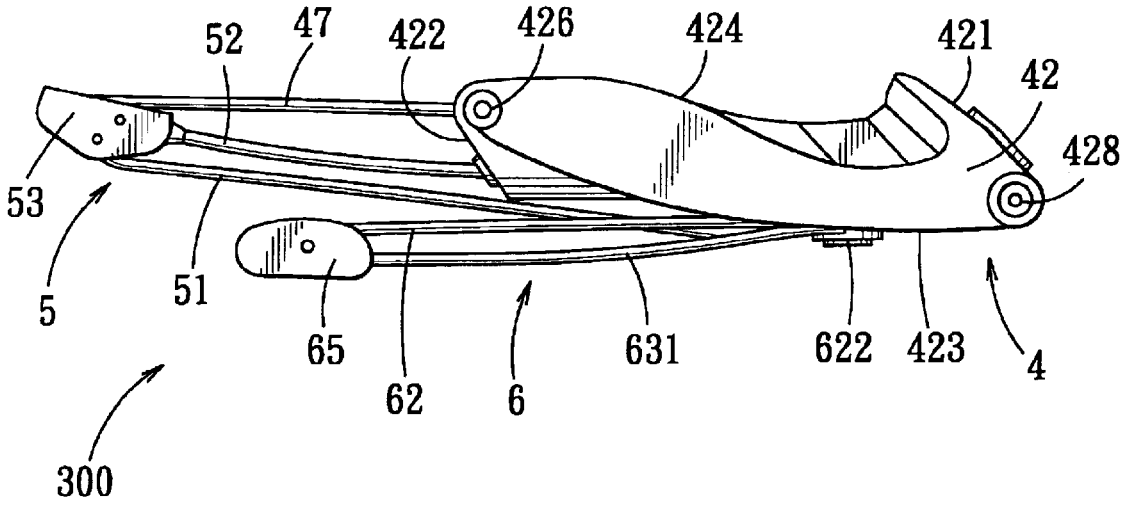
FIG. 5 is a schematic side view to illustrate a folded state of the preferred embodiment.

To fold the child support device 300, the seat support member 47 is first pivoted upwardly toward the first frame unit 5. Then, the first rod member 51 is operated to escape from the stop ribs 533 in the first connectors 53 and to pivot toward the front sides 413, 423 of the left and right frame portions 41, 42. Subsequently, the second rod member 62 is operated to escape from the stop ribs 653 in the second connectors 65 and to pivot downward relative to the third rod member 63. Finally, the third rod member 63 is operated to escape from the elongate grooves 4111, 4211 in the left and right frame portions 41, 42, and the folded second frame unit 6 is pivoted toward the front sides 413, 423 of the left and right frame portions 41, 42 until the rod connecting sections 631 abut against the rear step face 419, 429 of the front side 413, 423 of the respective frame portion 41, 42. FIG. 5 illustrates the child support device 300 in a completely folded state.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable child support device comprising:

a main frame unit including left and right frame portions;

a first frame unit including a first rod member with left and right rod ends, a pair of arm members, each of which has a rod connecting end and a frame connecting end opposite to said rod connecting end and connected to a respective one of said left and right frame portions, and a first connector unit for connecting pivotally and respectively said left and right rod ends of said first rod member to said rod connecting ends of said arm members such that said first frame unit is foldable about a first folding axis;

a second frame unit including a second rod member, a third rod member having a rod connecting section and a frame connecting section opposite to said rod connecting section and connected pivotally to said main frame unit such that said second frame unit is rotatable relative to said main frame unit about a second folding axis, and a second connector unit for interconnecting pivotally said second rod member and said rod connecting section of said third rod member such that said second frame unit is foldable about a third folding axis; and a seat support member mounted on said main frame unit and cooperating with said first frame unit to define a seating area, wherein said left and right rod ends of said first rod member are connected pivotally to said first connector unit, and said rod connecting ends of said arm members are connected non-rotatably to said first connector unit, said first connector unit being formed with stop means for providing resistance to pivoting movement of said first rod member when said first frame unit is in an unfolded state.

2. A foldable child support device comprising:

a main frame unit including left and right frame portions;

a first frame unit including a first rod member with left and right rod ends, a pair of arm members, each of which has a rod connecting end and a frame connecting end opposite to said rod connecting end and connected to a respective one of said left and right frame portions, and a first connector unit for connecting pivotally and respectively said left and right rod ends of said first rod member to said rod connecting ends of said arm members such that said first frame unit is foldable about a first folding axis;

a second frame unit including a second rod member, a third rod member having a rod connecting section and a frame connecting section opposite to said rod connecting section and connected pivotally to said main frame unit such that said second frame unit is rotatable relative to said main frame unit about a second folding axis, and a second connector unit for interconnecting pivotally said second rod member and said rod connecting section of said third rod member such that said second frame unit is foldable about a third folding axis; and a seat support member mounted on said main frame unit and cooperating with said first frame unit to define a seating area, wherein said second rod member and said rod connecting section of said third rod member are connected pivotally to said second connector unit, said second connector unit being formed with stop means for providing resistance to pivoting movement of said second rod member and said rod connecting section of said third rod member when said second frame unit is in an unfolded state.

* * * * *